US010435282B2

(12) United States Patent
Hora

(10) Patent No.: US 10,435,282 B2
(45) Date of Patent: Oct. 8, 2019

(54) WORK CAGE

(71) Applicant: Palfinger AG, Salzburg (AT)

(72) Inventor: Christian Hora, Eugendorf (AT)

(73) Assignee: Palfinger AG, Salzburg (AT)

( * ) Notice: Subject to any disclaimer, the term of this patent is extended or adjusted under 35 U.S.C. 154(b) by 0 days.

(21) Appl. No.: 15/011,988

(22) Filed: Feb. 1, 2016

(65) Prior Publication Data

US 2016/0236923 A1 Aug. 18, 2016

Related U.S. Application Data

(63) Continuation of application No. PCT/AT2014/000147, filed on Jul. 22, 2014.

(30) Foreign Application Priority Data

Aug. 2, 2013 (AT) ..... GM254/2013

(51) Int. Cl.
*B66F 11/04* (2006.01)
*B66F 17/00* (2006.01)

(52) U.S. Cl.
CPC ..... *B66F 11/044* (2013.01); *B66F 17/006* (2013.01)

(58) Field of Classification Search
CPC ..... B66F 11/044; B66F 17/006
See application file for complete search history.

(56) References Cited

U.S. PATENT DOCUMENTS 3,233,700 A * 2/1966 Myers ..... B66F 11/044 182/2.4
4,222,491 A * 9/1980 Geppert ..... B66C 23/905 212/276
4,456,093 A * 6/1984 Finley ..... B66F 17/006 182/18
4,553,632 A * 11/1985 Griffiths ..... B66F 11/044 182/19
4,602,462 A 7/1986 Anderson
5,944,138 A * 8/1999 Vollmer ..... B66F 11/044 182/2.1
2012/0323451 A1* 12/2012 Shatters ..... E02F 3/432 701/50

(Continued)

FOREIGN PATENT DOCUMENTS

DE 1 559 648 4/1970
DE 2 106 428 8/1972

(Continued)

OTHER PUBLICATIONS file:///C:/Users/cbradford/Documents/e-Red%20Folder/15011988/translation%20DE102015222485.pdf (Year: 2018).*

(Continued)

*Primary Examiner* — Katherine W Mitchell
*Assistant Examiner* — Candace L Bradford
(74) *Attorney, Agent, or Firm* — Wenderoth, Lind & Ponack, L.L.P.

(57) ABSTRACT

A lifting apparatus suspendably mounted on a holding apparatus, wherein during operation a pivot angle of the holding apparatus which deviates from a vertical straight line can be limited by a safety apparatus, wherein the pivot angle can be monitored and limited in two opposite directions, wherein swinging of the lifting apparatus back towards the vertical straight line is not impeded.

13 Claims, 7 Drawing Sheets

(56) References Cited

U.S. PATENT DOCUMENTS

| | | | | |
|---|---|---|---|---|
| 2014/0026550 | A1* | 1/2014 | Brinkman | F15B 21/14 60/414 |

FOREIGN PATENT DOCUMENTS

| | | | | |
|---|---|---|---|---|
| DE | 2 129 821 | | 1/1973 | |
| DE | 34 46 491 | | 7/1986 | |
| DE | 10201522485 | A1 * | 11/2014 | |
| DE | 102015222485 | A1 * | 5/2016 | E02F 3/301 |
| EP | 2 433 898 | | 3/2012 | |
| EP | 2433898 | A1 * | 3/2012 | B66F 11/046 |
| GB | 1145001 | | 3/1969 | |
| GB | 1 217 026 | | 12/1970 | |

OTHER PUBLICATIONS

Austrian Search Report dated Jun. 2, 2015 in corresponding Austrian Application No. 254/2013 (with English translation).
International Search Report dated Oct. 20, 2014 in corresponding International Application No. PCT/AT2014/000147 (with English translation).
Examiner's Search Report dated Jul. 4, 2017 in Canadian Application No. 2,920,040.

* cited by examiner

WORK CAGE

BACKGROUND OF THE INVENTION

The invention concerns a lifting apparatus mounted suspendably to a holding apparatus. In operation, a pivotal angle of the lifting apparatus deviating from a vertical straight line can be limited by way of a safety apparatus, and such a lifting apparatus can be part of a crane and a vehicle having such a crane.

Such lifting apparatuses are already known from EP 2 433 898 A1. In that specification, the lifting apparatus involves for example a work cage which is mounted in gravitationally levelling relationship to a rotary mounting and can be blocked and damped by a hydraulic cylinder. The hydraulic cylinder is blocked by a blocking valve disposed in a compensating line between the two chambers C1 and C2 of the hydraulic cylinder. That valve is controlled by a controlling unit and enables or closes off the through-flow between the chambers C1 and C2 of the hydraulic cylinder. In addition, there is a throttle action between the two chambers and thus the swinging movement of the lifting apparatus is damped. That damping admittedly causes a slowing of the swinging movement of the lifting apparatus but it does not prevent the lifting apparatus inclining severely when the operator leans out. For that reason, the blocking valve is disposed in the compensating line between the chambers C1 and C2.

European Standard 280 requires that in precisely such a situation, the lifting apparatus may not incline further than 5° relative to the horizontal. If that 5° angle is exceeded, the swinging movement must be automatically stopped. Furthermore, the European Standard 280 requires that, if a lifting angle movement is nonetheless continued, which is performed for example by way of the lifting apparatus which is connected to the crane, a further inclination above 10° is automatically stopped at the lifting apparatus. The above-mentioned patent specification discloses that only one blocking valve is installed in the compensating line. That gives rise to the disadvantage that, at any inclination above 5° up to 10° the blocking valve is blocked by way of the controlling unit and no compensation can take place between the chambers C1 and C2 at the hydraulic cylinder. The operator therefore has to connect the two chambers together by means of deactivation of the safety apparatus in order to be able to horizontally orient the lifting apparatus.

SUMMARY OF THE INVENTION

The object of the invention is to avoid that above-described disadvantage and to provide a system which is improved over the state of the art. In the lifting apparatus according to the invention, that object is achieved in that the pivotal angle is adapted to be monitorable and limitable in two mutually opposite directions, wherein swinging settlement of the lifting apparatus back in the direction of the vertical straight line remains unimpeded.

According to a further embodiment, the safety apparatus on the lifting apparatus comprises at least one sensor, for example an angle sensor, a controlling unit, and a blocking apparatus like for example at least one blocking valve in the form of a blocking valve. The angle sensor referred to by way of example, co-operating with the controlling unit, monitors permanently and in a fraction of a second the inclination of the lifting apparatus. As long as the inclination remains in a range below a first threshold value which can be predetermined by the controlling unit, the blocking apparatus remains open and the through-flow between the chamber C1 and the chamber C2 is enabled. In that range therefore the lifting working platform can freely swing. In that case, the operator of the lifting apparatus can now horizontally orient the lifting apparatus by displacement of weight and then block it in position by way of the blocking apparatus. The lifting apparatus should no longer swing in that position but should form a platform which is as stable as possible to be able to make the work easier.

In this example of use, blocking is effected by way of two blocking valves, for example solenoid valves, which close the communication between the chambers C1 and C2 and no longer ensure a through-flow between the two chambers. If however the crane moves, the lifting apparatus should be able to swing freely. In that case, both valves are opened as long as the lifting apparatus does not exceed an inclination of the previously input first threshold value. As soon as now a sensor registers an inclination beyond the first threshold value, which is caused for example by an operator leaning out, the safety apparatus immediately blocks the corresponding valve. Further tipping in that direction is therefore no longer possible. The second valve however remains opened and thus the operator can move the lifting apparatus back into a range below the first threshold value by moving his own weight without for example having to stop the crane movement or actuate a further valve. Thus, a return to below the first threshold value can always be possible without interrupting the travel movement and opening a further valve, and this can be extremely convenient for the operator of the lifting apparatus. Nonetheless, there can be the possibility that the cage is fixed in the working position by way of both blocking valves and that therefore affords a stable working surface.

BRIEF DESCRIPTION OF THE DRAWINGS

Further details and advantages of the present invention are described more fully hereinafter by means of the specific description with reference to the embodiments by way of example illustrated in the drawings in which.

DETAILED DESCRIPTION OF THE INVENTION

Figure 1:
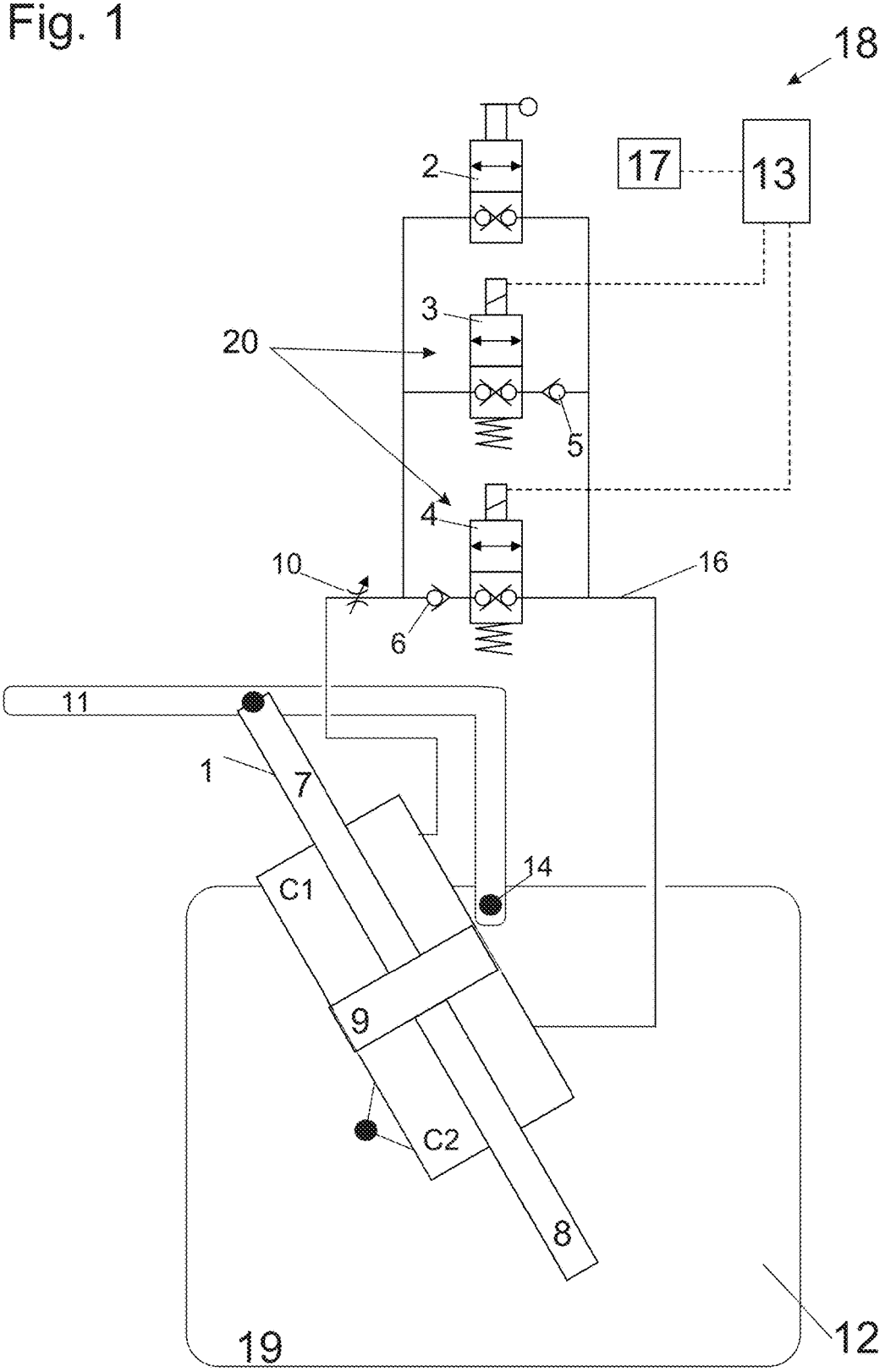
FIG. 1 shows a diagrammatic view of the safety apparatus in the working position of the lifting apparatus.
Figure 7:
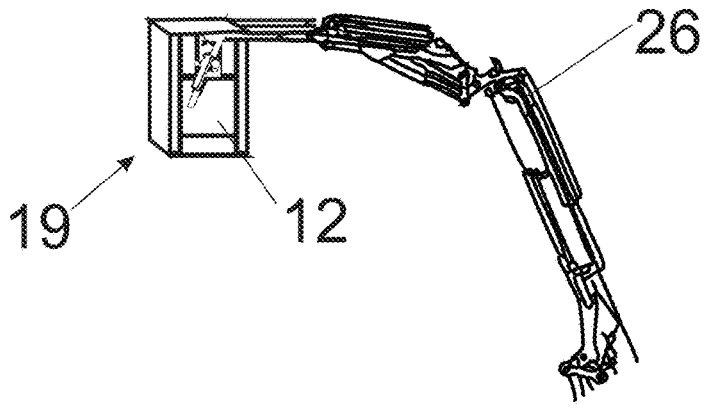
FIG. 7 shows a crane with fitted lifting apparatus.
Figure 8:
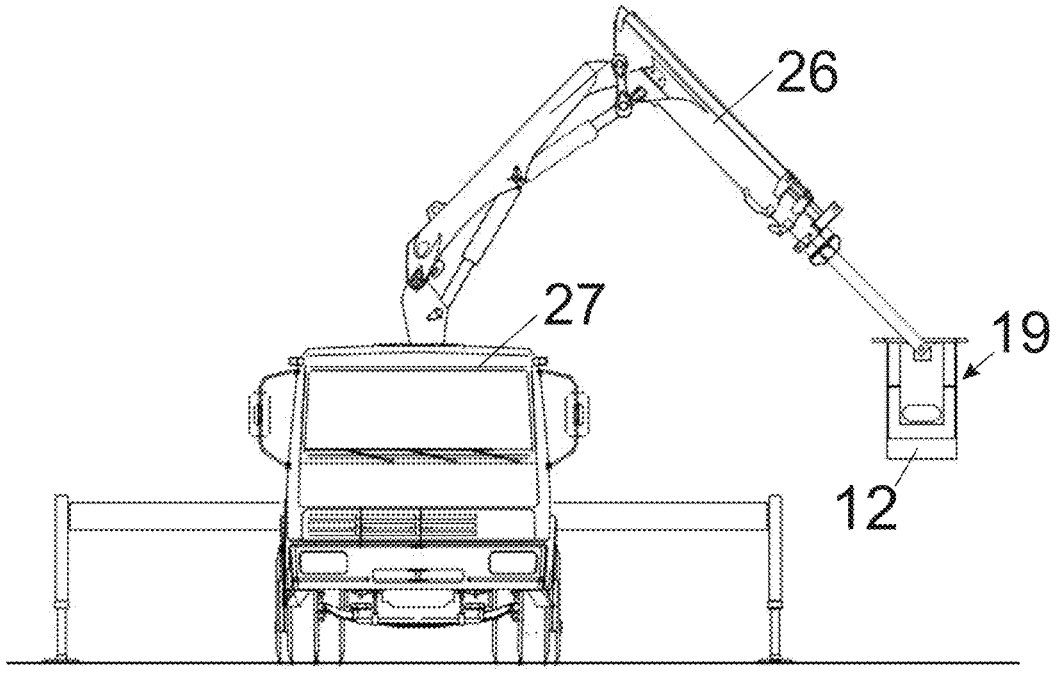
FIG. 8 shows a vehicle with fitted lifting apparatus on a crane.

FIG. 1 diagrammatically shows the condition of a blocked lifting apparatus (19), for example a work cage 12. The double-acting hydraulic piston-cylinder unit 1 comprising two chambers C1 and C2 and a piston 9 with two piston rods 7, 8 and a compensating line 16. A throttle 10 is disposed in the line 16. The throttle 10 is responsible for ensuring that compensation between the chambers C1 and C2 cannot take place too quickly. Therefore, the swinging action of the lifting apparatus 19 is damped down by way of that throttle 10. The non-return valve 6 prevents a compensating flow from the chamber C1 to the chamber C2. The non-return valve 5 prevents a compensating flow between the chamber C2 to the chamber C1. The through-flow between the chambers C1 and C2 could be made only by way of the blocking valves 3 and 4. In this embodiment, however, they are in their closed position as this involves blocking valves which are held in the closed condition by way of a spring as they are not powered. As the hydraulic piston-cylinder unit 1 is connected to the work cage 12 it therefore remains in position and affords a stable platform for the operator. As long as the work cage 12 was to be in that position and the crane 26 does not move (see FIG. 7), no current is also passed to the blocking valves 3 and 4 by the controller 13. As shown in FIG. 8, the crane 26 can be attached to a vehicle frame of a vehicle 27

Figure 2:
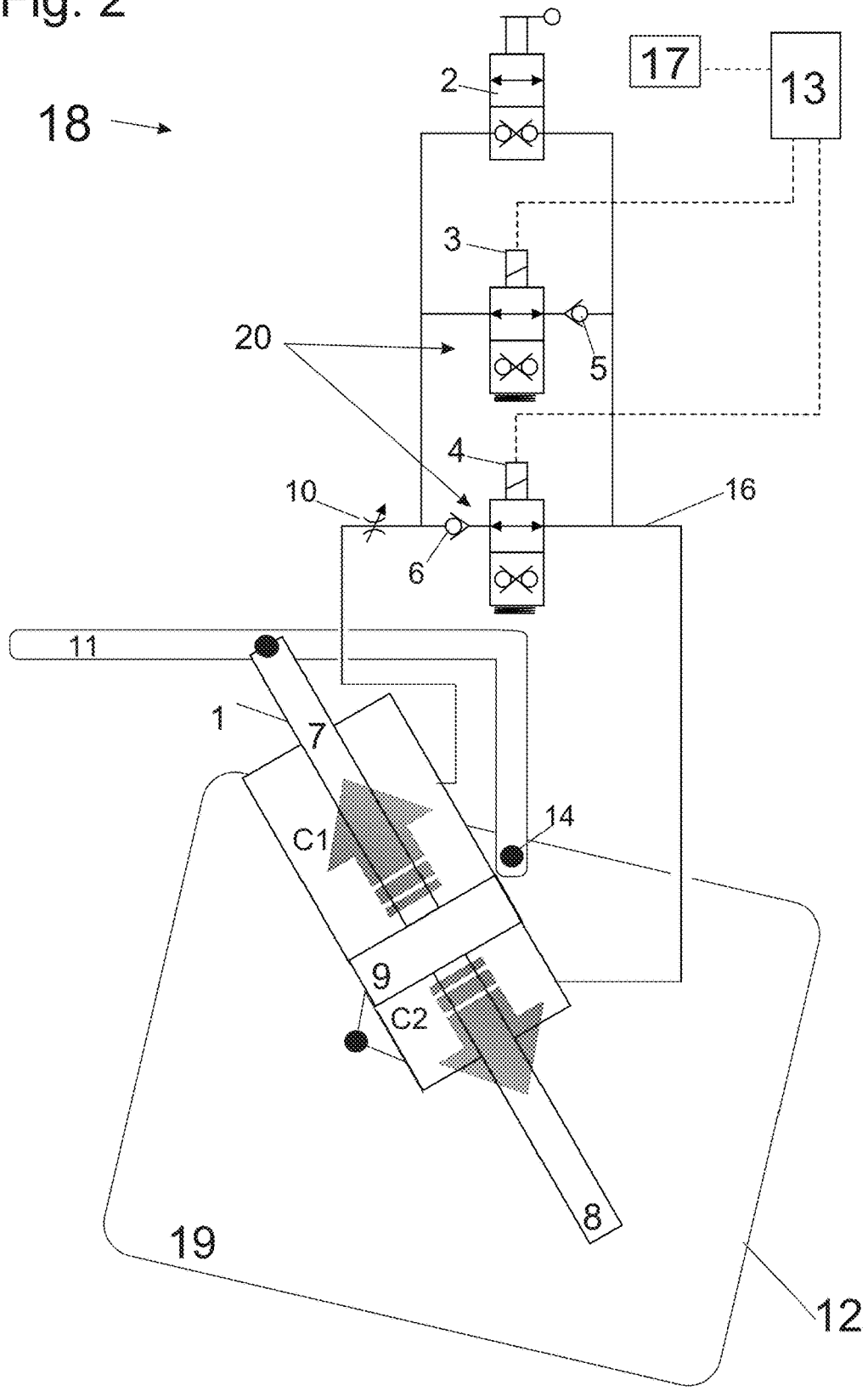
FIG. 2 shows a diagrammatic view of the safety apparatus during the crane movement and below the first threshold value.

FIG. 2 now shows the safety apparatus 18 during displacement with the crane 26 below a first threshold value, the blocking valves 3 and 4 being powered by the controller 13. It is thus possible for the oil to be displaced out of the chamber C2 into the chamber C1 and the oil to be displaced from the chamber C1 into the chamber C2. That occurs by way of the two opened blocking valves 3 and 4. The oil can further be displaced from the chamber C2 through the compensating line 16 by way of the opened blocking valve 4 into the chamber C1 by way of the non-return (check) valve 6. The oil from the chamber C1 can also be displaced by way of the compensating line 16 and by way of the opened blocking valve 3 further into the chamber C2 by way of the non-return (check) valve 5. The oil flow between the two chambers is in that case damped by the throttle 10. The bridging apparatus 2 always remains in the closed condition in that situation.

Figure 3:
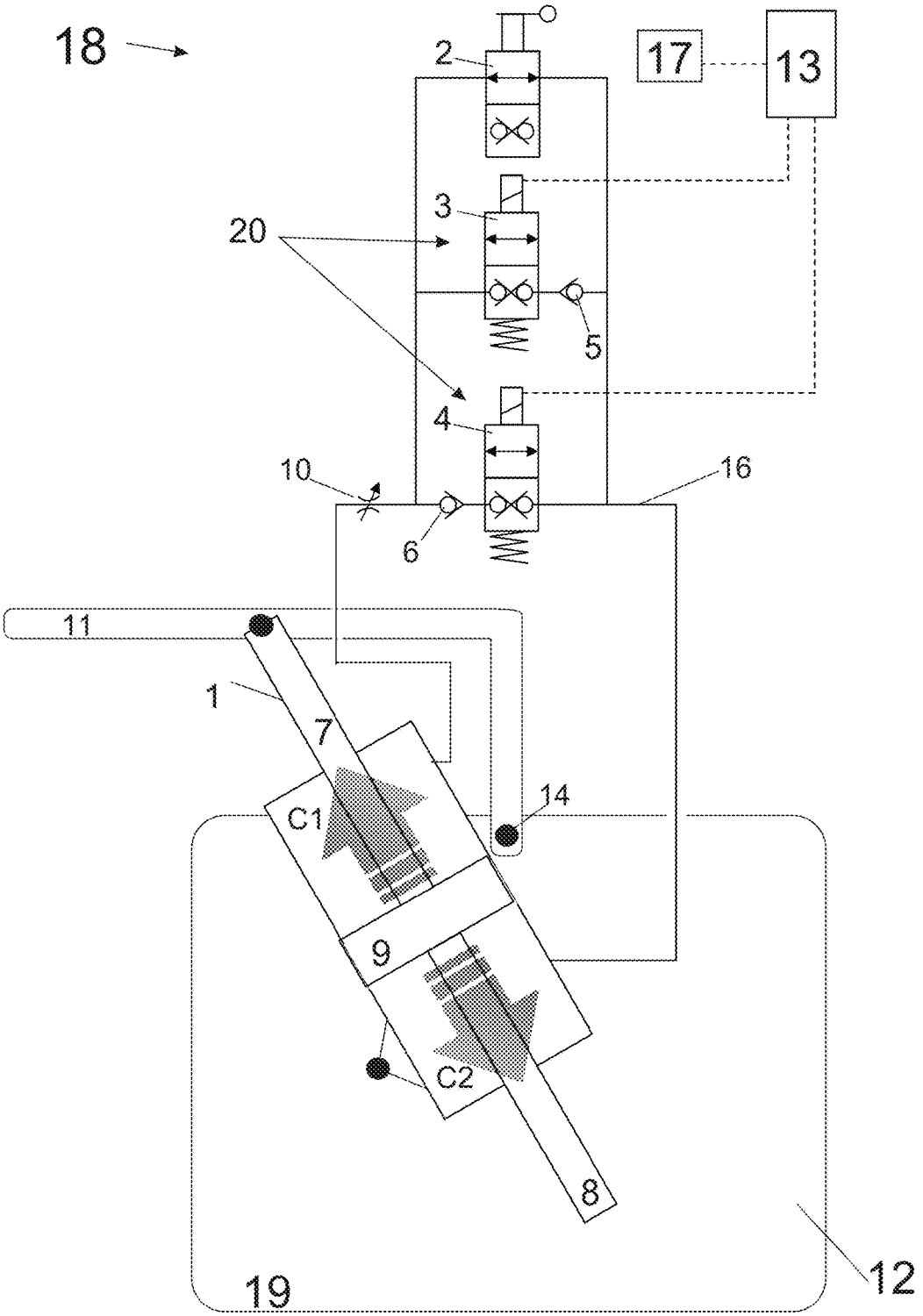
FIG. 3 shows a diagrammatic view of the safety apparatus in which the second threshold value was exceeded and the bridging apparatus is activated.

FIG. 3 shows two unpowered blocking valves 3 and 4. In this example, of use the lifting apparatus 19 has been inclined above an angle of the second threshold value. To be able to prevent further inclination, the two chambers C1 and C2 are now blocked and return pivotal movement into the neutral position is now possible when the bridging apparatus (i.e., bridging valve) 2 is manually actuated. Upon manual actuation of the bridging apparatus 2, the flow between C1 and C2 is restored and the function of the blocking valves 3 and 4 is bridged over. In this case, the return pivotal movement into the neutral position is damped by way of the throttle 10. In addition, upon inclination of the lifting apparatus 19 above the second threshold value, the crane is automatically shut down and further displacement with the crane is not possible.

Figure 4:
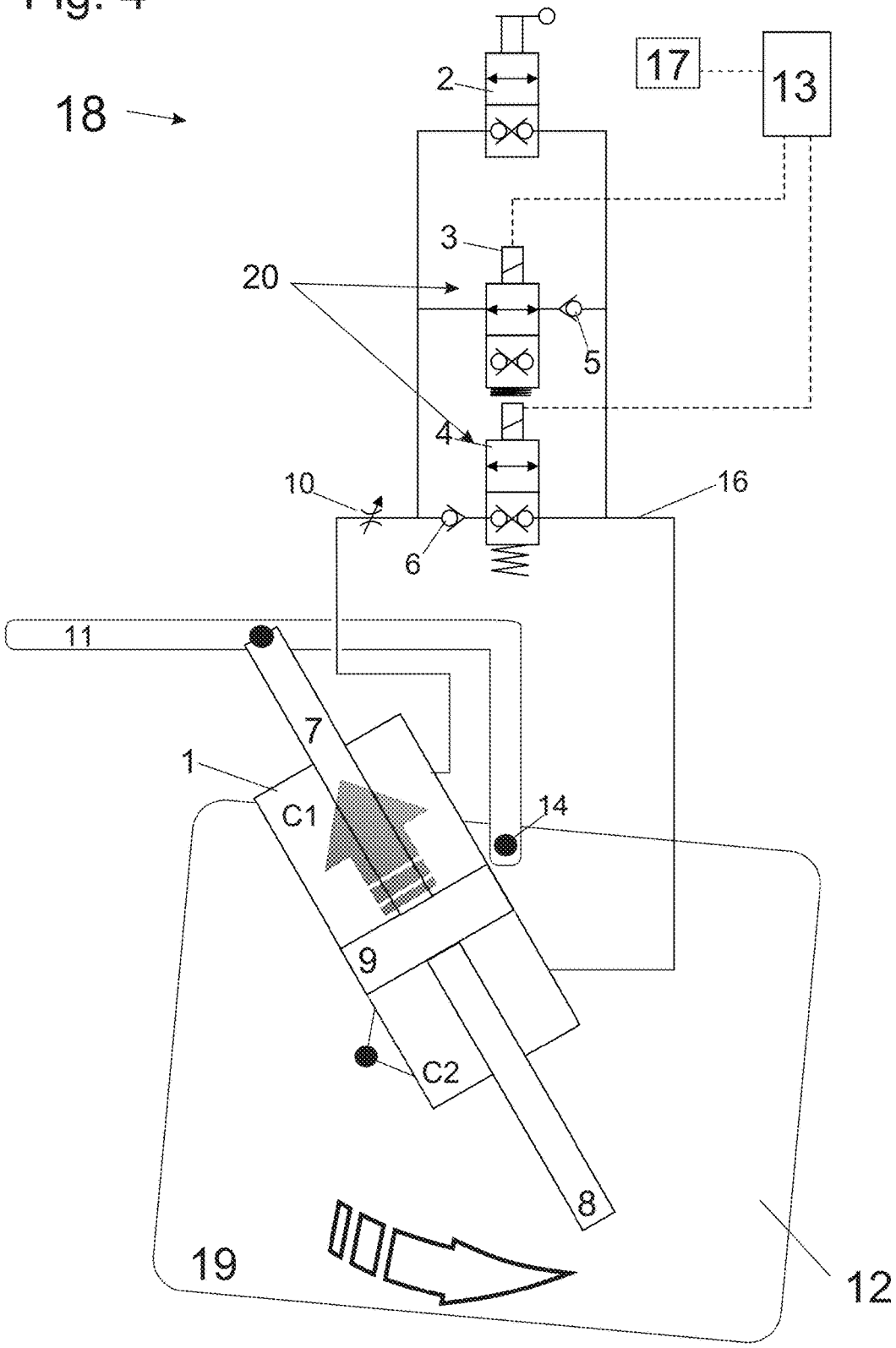
FIG. 4 shows a diagrammatic view of the safety apparatus with enabled through-flow from cylinder chamber C2 to cylinder chamber C1 at a pivotal angle between the first threshold value and the second threshold value.

FIG. 4 shows how the oil flows from the chamber C1 by way of the compensating line 16 into the blocking valve 3 which is powered by the controller 13. In addition, the oil flows by way of the non-return (check) valve 5 into the chamber C2. It is however not possible for the oil to be displaced back from the chamber C2 into the chamber C1 as the blocking valve 4 is not powered and is thus closed. That switching position occurs when the lifting apparatus 19 is in a position between the first threshold value and the second threshold value. This means that further outward pivotal movement of the lifting apparatus 19 into an unstable position which would lead to danger to the operator is no longer possible, but return pivotal movement into a stable position of the lifting apparatus 19 remains open. The operator of the lifting apparatus 19 can now move the lifting apparatus 19 into a neutral position again simply by weight displacement without having to actuate a valve or shut down the crane. The direction in which the lifting apparatus 19 pivots in that case or the extent to which the angle deviates from the first threshold value is registered by the sensor 17. If now the operator pivots the lifting apparatus back to a value below the first threshold value by virtue of weight displacement, that is at the same time detected by the at least one sensor 17 and passed to the controlling unit 13. The controlling unit 13 thereupon again powers up both blocking valves 3 and 4 and the exchange of oil between chamber C1 and chamber C2 can again take place, as shown in FIG. 2.

Figure 5:
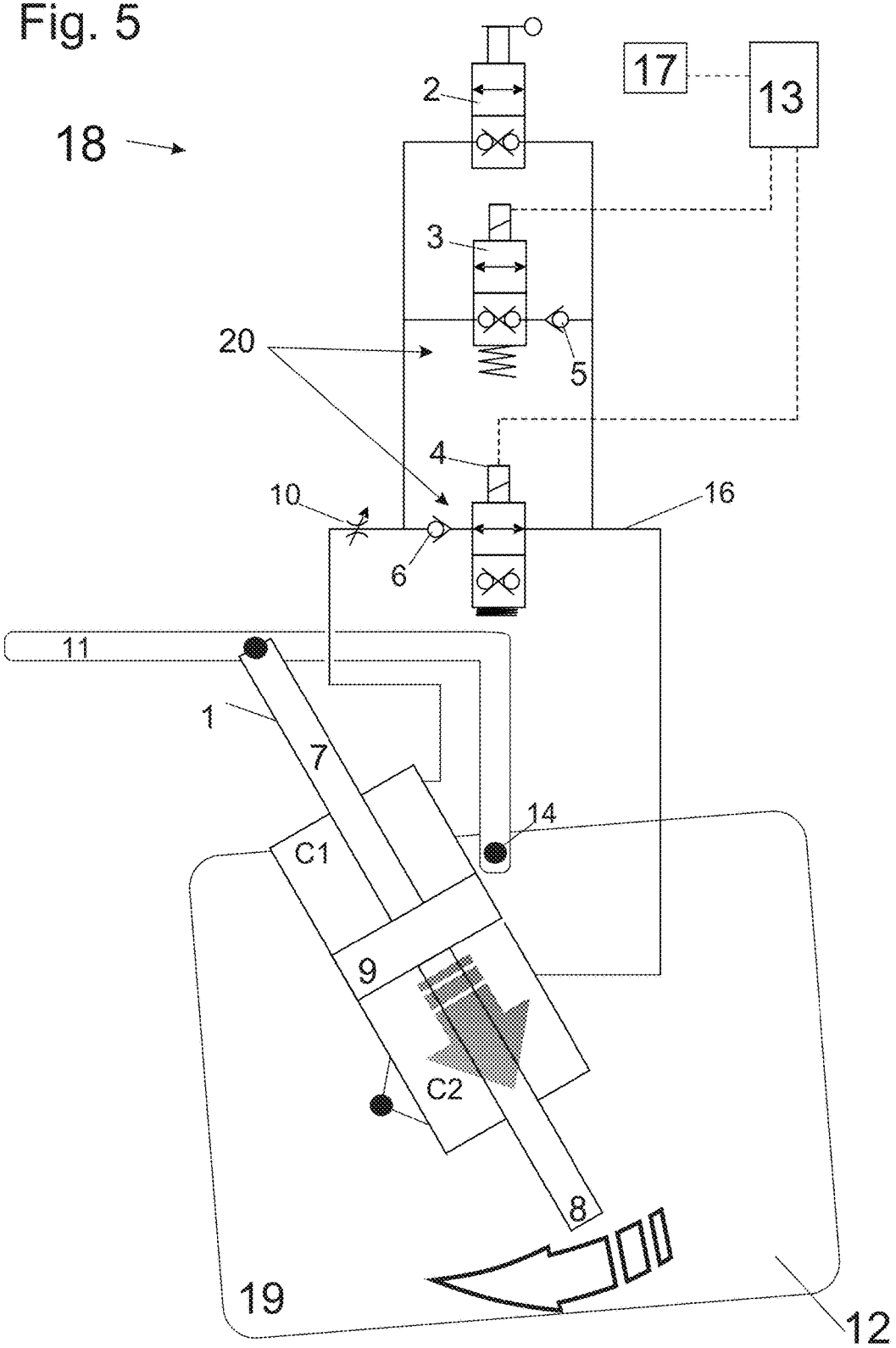
FIG. 5 shows a diagrammatic view of the safety apparatus with opened through-flow from cylinder chamber C1 to cylinder chamber C2 at a pivotal angle between the first threshold value and the second threshold value.
Figure 6A:
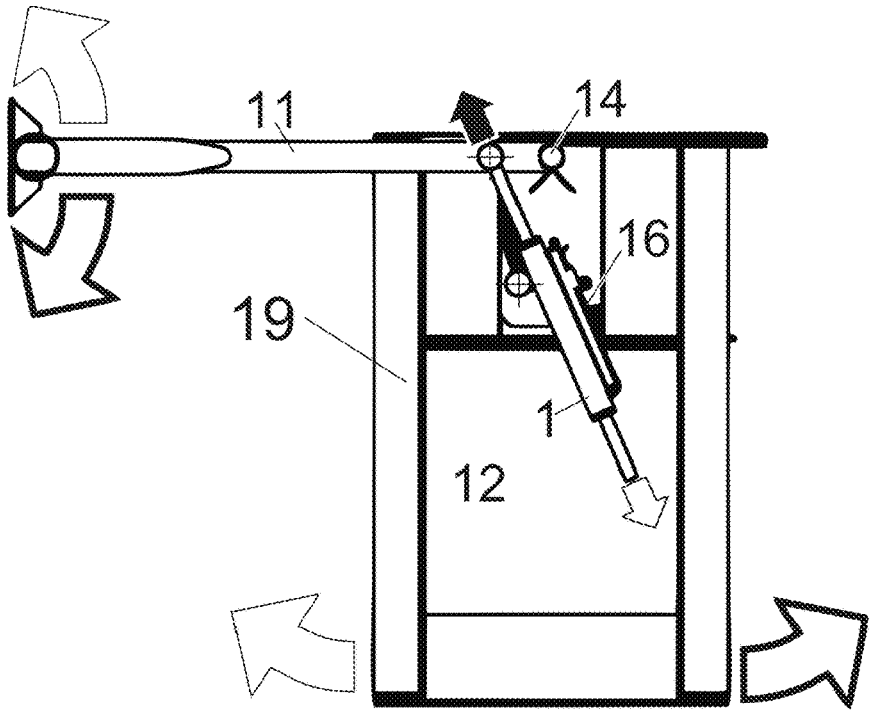
FIG. 6*a* shows the lifting apparatus having a cylinder, fixed at the piston rod side to the holding apparatus and connected at the cylinder casing side to the lifting apparatus.
Figure 6B:
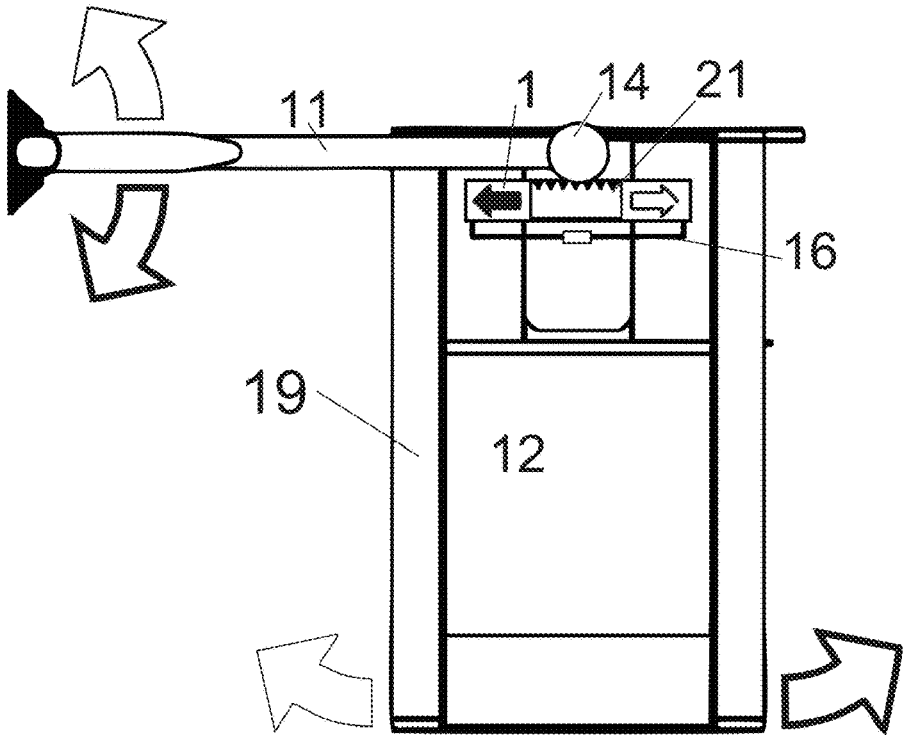
FIG. 6*b* shows the lifting apparatus with the hydraulic cylinder disposed on a toothed rack.

FIG. 5 shows a powered blocking valve 4, in which case now the exchange from chamber C1 to chamber C2 can take place, but not in the reverse sequence. As already explained in relation to FIG. 4, the operator of the lifting apparatus 19 can now level the lifting apparatus 19 back to a value below the first threshold value again by means of weight displacement—only this time in the opposite direction, as described in relation to FIG. 4. Here too the operator does not have to shut down the crane or actuate an additional valve in order to produce a leveling effect.

FIG. **6*a* shows the lifting apparatus 19, by way of example a work cage 12 on a holding apparatus (i.e., holding arm) 11 with a rotary mounting 14. The work cage 12 is mounted rotatably (pivotably) on the rotary mounting 14. The holding apparatus 11 and the work cage 12 are additionally connected together by way of the hydraulic piston cylinder unit 1. In this case, the cylinder casing can be connected to the work cage 12 and one of the cylinder rods 7, 8 can be connected to the holding apparatus 11. The hydraulic cylinder 1 is filled with oil in both chambers C1 and C2, and both chambers C1, C2 are connected together with a compensating line 16. The oil 11 is now necessarily displaced in the movement of the work cage 12 from the chamber C1 into the chamber C2 or the chamber C2 into the chamber C1**.

FIG. **6*b* shows the lifting apparatus 19, by way of example a work cage 12. Here the lifting apparatus 19 is not supported on the holding apparatus 11 directly by way of the hydraulic cylinder 1, but the damping and/or blocking action of the hydraulic cylinder 1 is passed indirectly by way of a toothed rack 21 to the lifting apparatus 19. A toothed rack 21 is fixed for that purpose to the hydraulic cylinder 1. That toothed rack 21 engages into a gear on the rotary mounting 14. Movements at the work cage 12 are thus passed by way of the gear in the rotary mounting 14 to the toothed rack 21 and throttled or also blocked by the hydraulic cylinder 1**.

The invention claimed is:

1. A lifting apparatus to be suspended from a holding arm, said lifting apparatus comprising:

a work cage to be pivotably mounted to the holding arm;

a hydraulic piston-cylinder unit to be operationally mounted between said work cage and the holding arm, said piston-cylinder unit including a cylinder and a piston dividing said cylinder into a pair of chambers;

a compensating line connecting said pair of chambers of said cylinder;

a pivot angle detecting sensor for detecting an inclination of said work cage;

a blocking apparatus in said compensating line, said blocking apparatus including at least two blocking valves arranged in co-operable relationship with at least two non-return valves in said compensating line and configured to cooperate with said hydraulic piston-cylinder unit; and a controller connected to said sensor and said blocking apparatus;

wherein said hydraulic piston-cylinder unit, said compensating line, said controller, said sensor, and said blocking apparatus are configured such that, when said sensor detects a pivot angle of said work cage deviating from a vertical straight line by an amount at least as great as a predetermined threshold value, said controller operates said blocking apparatus to limit a flow from a first one of said pair of chambers to a second one of said pair of chambers of said cylinder to thereby limit any further pivotal movement which would increase the pivot angle, and said controller operates said blocking apparatus to allow a flow from said second one of said pair of chambers to said first one of said pair of chambers to thereby allow a pivotal movement back in a direction of the vertical straight line and thereby reduce the pivot angle to allow said work cage to be made level by weight displacement within said work cage;

wherein said at least two blocking valves and said at least two non-return valves are configured to block or allow through-flow from said first one of said pair of chambers to said second one of said pair of chambers by a first one of said at least two blocking valves in co-operating relationship with a first one of said at least two non-return valves, and to block or allow through-flow from said second one of said pair of chambers to said first one of said pair of chambers by a second one of said at least two blocking valves in co-operating relationship with a second one of said at least two non-return valves.

2. The lifting apparatus as set forth in claim 1, wherein said controller is configured to operate said blocking apparatus to allow the flow from the first one of said pair of chambers to the second one of said pair of chambers of said cylinder when said sensor detects that the pivot angle is deviating from the vertical straight line in an amount smaller than the predetermined threshold value.

3. The lifting apparatus as set forth in claim 1, wherein said controller is configured to operate said blocking apparatus to prevent the flow from the first one of said pair of chambers to the second one of said pair of chambers of said cylinder when said sensor detects that the pivot angle is deviating from the vertical straight line in an amount greater than the predetermined threshold value.

4. The lifting apparatus as set forth in claim 3, further comprising a bridging valve for pivotably damping said work cage relative to the vertical straight line with said blocking apparatus preventing flow between said pair of chambers of said cylinder in both directions.

5. The lifting apparatus as set forth in claim 1, wherein said controller, said sensor, and said blocking apparatus are configured such that, when said sensor detects the pivot angle deviating from the vertical straight line and in a range between a predetermined first threshold value and a predetermined second threshold value, said controller operates said blocking apparatus to limit a pivotal movement which would increase the pivot angle and thereby allow the pivotal movement back in the direction of the vertical straight line.

6. The lifting apparatus as set forth in claim 1, wherein said sensor is configured to ascertain the pivot angle of said work cage, and to forward a value of the ascertained pivot angle to said controller.

7. The lifting apparatus as set forth in claim 6, wherein said controller stores the predetermined threshold value, and is configured to compare the value of the ascertained pivot angle to the predetermined threshold value.

8. The lifting apparatus as set forth in claim 6, wherein said blocking apparatus comprises at least two blocking valves, said controller being configured to actuate said at least two blocking valves individually or simultaneously to thereby close or allow flow into one or both of said pair of chambers.

9. The lifting apparatus as set forth in claim 1, wherein said hydraulic piston-cylinder unit is configured to connect said work cage to the holding arm.

10. The lifting apparatus as set forth in claim 9, wherein a casing of said cylinder of said hydraulic piston-cylinder unit is connected to said work cage and a piston rod of said piston of said hydraulic piston-cylinder unit is to be connected to the holding arm.

11. A crane comprising:

a holding arm having a rotary mounting; and said lifting apparatus as set forth in claim 1, said lifting apparatus being pivotably mounted to said rotary mounting of said holding arm.

12. The crane as set forth in claim 11, wherein a casing of said cylinder of said hydraulic piston-cylinder unit is connected to said work cage, and a piston rod of said piston of said hydraulic piston-cylinder unit is connected to said holding arm.

13. A vehicle comprising:

a vehicle frame; and said crane as set forth in claim 11, said crane being mounted to said vehicle frame.

* * * * *